United States Patent [19]

Schick et al.

[11] Patent Number: 4,492,589

[45] Date of Patent: Jan. 8, 1985

[54] ANIONIC DISPERSANTS FOR AQUEOUS SLURRIES OF CARBONACEOUS MATERIALS

[75] Inventors: Martin J. Schick, New York, N.Y.; Edwin L. Kelley, Succasunna, N.J.

[73] Assignee: Diamond Shamrock Chemicals Company, Dallas, Tex.

[21] Appl. No.: 419,753

[22] Filed: Sep. 20, 1982

[51] Int. Cl.[3] ..... C10L 1/32

[52] U.S. Cl. ..... 44/51; 44/70; 44/76; 252/354; 406/47; 406/49; 406/197

[58] Field of Search ..... 44/51, 70, 76; 252/354; 406/47, 49, 197

[56] References Cited

U.S. PATENT DOCUMENTS

| | | | |
|---|---|---|---|
| 4,177,039 | 12/1979 | Sakuma et al. | 44/51 |
| 4,196,092 | 4/1980 | Wang et al. | 252/354 |
| 4,282,006 | 8/1981 | Funk | 44/51 |
| 4,302,212 | 11/1981 | Yamamura et al. | 44/51 |
| 4,330,301 | 5/1982 | Yamamura et al. | 44/51 |

*Primary Examiner*—William R. Dixon, Jr.
*Assistant Examiner*—Margaret B. Medley
*Attorney, Agent, or Firm*—Neal T. Levin

[57] ABSTRACT

Aqueous carbonaceous slurries having reduced viscosity, a stabilized network of carbonaceous material in water and improved pumpability are obtained by having present as a dispersant an alkali or ammonium bis-alkyl sulfosuccinate. An example is the sodium salt of bis-2-ethylhexyl sulfosuccinate.

11 Claims, No Drawings

ANIONIC DISPERSANTS FOR AQUEOUS SLURRIES OF CARBONACEOUS MATERIALS

BACKGROUND OF THE INVENTION

1. Field of the Invention

This invention relates to aqueous carbonaceous slurries and more particularly to aqueous coal slurries stabilized with water soluble alkali or ammonium bis-alkyl sulfosuccinates.

2. Description of the Prior Art

Transport is one of the major problems involved in use of particulate carbonaceous materials such as coal. One method of transport involves aqeuous slurries. However, aqueous slurries of finely ground coal containing over 55 weight percent solids are difficult to pump with slurry pumps. This is because as the solids level is increased above 50 weight percent, water and solids tend to separate causing coal particles to build up in various areas in the pumping system. This dewatering of the slurry causes blockage and jamming in the pumping system.

On the other hand, decreasing the weight percent of water in aqueous coal slurries is desirable because water is a major contributor to the cost of transport and processing operations. The less water transported the greater the volume of coal that can be moved, resulting in transport efficiencies. Further, water resources are limited. Also, during burning of coal, a significant amount of heat is required to vaporize the water. As the weight percent of water decreases, the efficiency of the coal burning process increases. Hence, use of higher weight percent solids aqueous carbonaceous slurries than was heretofore feasible would be of great importance.

It is known that anionic surfactants with sulfonate groups are dispersants for coal water slurries. Examples taken from the literature appear below.

U.S. Pat. No. 4,282,006—Funk, Aug. 4, 1981, describes a pipeline pumpable coal water slurry having a high content of coal particles with a minimum of void spaces and a maximum of particle surface area to enhance dispersing effects generated by electrolytes and/or dispersing agents added to the slurry. For anionic dispersing agents, see Column 29, line 53 to Column 31, line 9.

U.S. Pat. No. 4,302,212—Yamamura et al, Nov. 24, 1981, describes dispersing agents for aqueous coal slurries which are anionic surface active agents having the formula:

$$[R—O—CH_2CH_2O—_mSO_3]_nM$$

wherein R is an alkyl or alkenyl group having 6 to 22 carbon atoms or an alkyl- or alkenyl-substituted aryl group having 4 to 22 carbon atoms in the substituent thereof, m is an integer of from 2 to 50, n is a number of from 1 to 3 and is the same as the valence of the counter ion M, and M is a cation having a valence of from 1 to 3.

U.S. Pat. No. 4,330,301—Yamamura et al, May 18, 1982, describes anionic dispersants for aqueous coal slurries which are sulfonation products of polycyclic aromatic compounds, salts thereof and formaldehyde condensates thereof.

SUMMARY OF THE INVENTION

Stabilized aqueous carbonaceous slurries having reduced viscosity, a stabilized network of carbonaceous material in water and improved pumpability are obtained by using alkali or ammonium bis-alkyl sulfosuccinates as dispersant, said dispersant present in an amount sufficient to reduce the viscosity of the slurry, stabilize the network of carbonaceous material in water and improve pumpability.

DESCRIPTION OF THE PREFERRED EMBODIMENTS

One or a mixture of dispersants selected from the group consisting of the sodium, potassium, lithium and ammonium salts of bis-alkyl sulfosuccinates is present in the slurry in amounts sufficient to reduce the viscosity of the slurry, stabilize the network of carbonaceous material in water and improve the pumpability of the slurry. For example, from about 0.1% by weight to about 10.0% by weight of the dispersant based on the weight of the carbonaceous material can be used. The resulting slurries will generally have about 60% by weight solids and 40% by weight water to which the dispersant is added, usually as a solution.

The bis-alkyl sulfosuccinates which are useful herein have the following general structure:

$$[R^1OOC—CH_2—\underset{\underset{SO_3}{|}}{CH}—COOR^2]^-M^+$$

wherein $R^1$ and $R^2$ represent straight or branched chain alkyl groups having from about 4 to about 12 carbon atoms, $R^1$ and $R_2$ being the same or different and M is a cation selected from the group consisting of sodium, potassium, lithium and ammonium.

These may be used as 100% active materials or in the form of aqueous solutions of same. Examples of bis-alkyl sulfosuccinates which are useful herein are one or more of the following:

Sodium salt of bis-2-ethylhexyl sulfosuccinate
Sodium salt of bis-n-octyl sulfosuccinate
Sodium salt of bis-isodecyl sulfosuccinate (Aerosol A-268 American Cyanamid Company)
Sodium salt of bis-hexyl sulfosuccinate (Aerosol MA-20 American Cyanamid Company)
Ammonium salt of bis-2-ethylhexyl sulfosuccinate
Ammonium salt of bis-n-octyl sulfosuccinate The term "carbonaceous materials" as used herein encompasses solid particulate carbonaceous fossil fuel materials which are crushed and milled to obtain finely divided particles suitable for use in pumpable water slurries. Generally, these materials are powdered or pulverized to a size where at least 80% will pass through a 200 mesh screen (U.S. Series). Useful carbonaceous materials include bituminous and anthracite coals, coke, petroleum coke, lignite, charcoal, peat, admixtures thereof and the like.

Water used in the slurry may be taken from any available source such as mine, well, river, or lake water or desalinated ocean water having a sufficiently low mineral salt content such that the electrochemistry of the bound water layer and carrier water interface can be controlled and corrosion of milling facilities, pipelines and furnaces will be minimized and controllable.

For a fuller understanding of the nature and advantages of this invention, reference may be made to the following examples. These examples are given merely to illustrate the invention and are not to be construed in a limiting sense.

EVALUATION OF DISPERSANTS FOR AQUEOUS CARBONACEOUS SLURRIES

The following procedure was utilized in the evaluation of the products of the examples in aqueous coal slurries. This is achieved by determining the ability of the products to disperse or suspend coal dust uniformly in water by measuring viscosity and examining the sediment, if formed.

APPARATUS USED 8-oz. paint cans
Low shear mechanical mixer with a double blade
Spatula
Stormer viscometer

REAGENTS USED

Water of known record hardness
Coal dust-Reference coal is Pittston Coal, 80% through 200 mesh (U.S. Series). Other types of coal and grind sizes can be substituted.
Dispersant

PROCEDURE

1. A slurry of coal dust in water is prepared as follows. Coal dust is slowly added to water under agitation by a low shear mechanical mixer with a double blade. (Do not use a "Lightnin" high speed mixer.) Sides of the container are scraped regularly while mixing. The slurry is agitated for an additional hour to ensure uniformity.
2. Viscosity of the aqueous coal slurry is determined by weighing out 200 gram samples of the slurry into 8 oz paint cans. A specific quantity of product is added to each under vigorous agitation. All cans are closed tightly to prevent evaporation of water.
3. Each can is opened and each slurry is stirred with a spatula before viscosity measurements are made with a Stormer Viscometer. Weights are adjusted in order to find a reading as close as possible to 30 seconds and the correct weight for a 30-second viscosity is determined. Readings are repeated twice after stirring each time and should not differ by more than 2 seconds. Readings are repeated until consistent and the average of two readings taken.
4. Seconds and weight are converted into krebs units which are then converted to centipoise readings.

In the Examples, all percents by weight are percents by weight based upon the total weight of the carbonaceous material (coal).

EXAMPLE I

The effect of addition of sodium bis-2-ethylhexyl sulfosuccinate and sodium bis-n-octyl sulfosuccinate upon the viscosity of the slurries is illustrated in Table A. Slurry viscosities were determined with a Stormer viscometer. Marked lowering of the slurry viscosities are apparent on addition of the sodium bis-alkyl sulfosuccinates. The slurries were prepared and tested in accordance with the test procedure given above. The composition is given below.

| Component | % By Wt. |
|---|---|
| Pittston Coal (80% <200 mesh U.S. | 60 |

-continued

| Component | % By Wt. |
|---|---|
| Sieve Series) | |
| Distilled Water | Varies |
| Sodium bis-2-ethylhexyl sulfosuccinate (50% by weight aqueous solution) or Sodium bis-n-octyl sulfosuccinate (60% by weight aqueous solution) | Varies |

The effect of sodium bis-2-ethylhexyl sulfosuccinate and sodium bis-n-octyl sulfosuccinate upon viscosity of coal/water slurries is shown in Tables A and B below.

TABLE A

| % By Wt. Sodium Bis-2-Ethylhexyl Sulfosuccinate Based on Weight of Coal | Viscosity at 25.0° C. (cps) |
|---|---|
| 0.00 (Control) | 4,700 |
| 0.10 | >4,000 |
| 0.125 | 4,000 |
| 0.15* | 3,700 |
| 0.208 | 3,063 |
| 0.25* | 2,000 |
| 0.292 | 1,550 |
| 0.35* | 1,400 |
| 0.417 | 1,400 |

*Extrapolated

TABLE B

| % By Wt. Sodium Bis-n-Octyl Sulfosuccinate Based on Weight of Coal | Viscosity at 25.0° C. (cps) |
|---|---|
| 0.00 (Control) | 4,700 |
| 0.05 | >4,500 |
| 0.15 | 2,928 |
| 0.208* | 1,700 |
| 0.25 | 1,233 |
| 0.292* | 1,030 |
| 0.35 | ·875 |
| 0.417* | 875 |
| 0.50 | 950 |

*Extrapolated

EXAMPLE II

Coal slurries were prepared comprising 60% by weight of the slurry of Pittston coal (80% <200 mesh U.S. Sieve Series), distilled water and 0.5% by weight dispersant based on the weight of the coal in a manner described in the test procedure. Slurry viscosities were determined with a Stormer viscometer. Viscosity of the control (without added dispersant) was 3,060 cps. Addition of 0.5% by weight sodium bis-hexyl sulfosuccinate (80% by weight aqueous solution) based on the weight of the coal reduced the viscosity of the slurry to 975 cps. Likewise, addition of 0.5% by weight sodium bis-isodecyl sulfosuccinate (50% by weight aqueous solution) based on the weight of the coal reduced the viscosity of the slurry to 850 cps.

EXAMPLE III

Coal slurries were prepared comprising 60% by weight of the slurry of Pittston coal (80% <200 mesh U.S. Sieve Series), distilled water and 0.5% by weight dispersant based on the weight of the coal in a manner described in the test procedure. Slurry viscosities were determined with a Stormer viscometer. Viscosity of the control (without added dispersant) was 3,060 cps. Addition of 0.5% by weight ammonium bis-2-ethylhexyl sulfosuccinate (50% by weight aqueous solution) based on the weight of the coal reduced the viscosity of the slurry to 2,643 cps. Likewise, addition of 0.5% by weight ammonium bis-n-octyl sulfosuccinate reduced the viscosity of the slurry to 2,325 cps.

While the invention has been described with reference to certain specific embodiments thereof, it is understood that it is not to be so limited since alterations and changes may be made therein which are within the full intended scope of the appended claims.

What is claimed is:

1. An aqueous carbonaceous slurry consisting essentially of carbonaceous material and water, the carbonaceous material of a size such that at least 80% will pass through a 200 mesh screen, containing at least one dispersant having the formula $$[R^1OOC-CH_2-\underset{\underset{SO_3}{|}}{CH}-COOR^2]^- M^+$$

where $R^1$ and $R^2$ represent straight or branched chain alkyl groups having from about 4 to about 12 carbon atoms, $R^1$ and $R^2$ being the same or different, and M is a cation selected from the group consisting of sodium, potassium, lithium and ammonium said dispersant present in an amount sufficient to reduce viscosity of the slurry, stabilize the network of carbonaceous material in water and improve pumpability.

2. The slurry of claim 1 wherein said dispersant is present in an amount of from about 0.1% by weight to about 10.0% by weight of the carbonaceous material present in the slurry.

3. The slurry of claim 2 wherein said carbonaceous material is coal.

4. The slurry of claim 2 wherein said dispersant is the sodium salt of bis-2-ethylhexyl sulfosuccinate.

5. The slurry of claim 2 wherein said dispersant is the sodium salt of bis-n-octyl sulfosuccinate.

6. The slurry of claim 2 wherein said dispersant is the sodium salt of bis-isodecyl sulfosuccinate.

7. The slurry of claim 2 wherein said dispersant is the sodium salt of bis-hexyl sulfosuccinate.

8. The slurry of claim 2 wherein said dispersant is the ammonium salt of bis-2-ethylhexyl sulfosuccinate.

9. The slurry of claim 2 wherein said dispersant is the ammonium salt of bis-n-octyl sulfosuccinate.

10. A process for preparing stable aqueous carbonaceous slurries consisting essentially of carbonaceous material and water, the carbonaceous material of a size such that at least 80% will pass through a 200 mesh screen, comprising incorporating into said slurry the dispersant of claim 1 in an amount sufficient to reduce water content of the slurry, stabilize the network of carbonaceous material in water and improve pumpability.

11. The process of claim 10 wherein said carbonaceous material is coal.

* * * * *